US007147108B2

(12) United States Patent
Nickel

(10) Patent No.: US 7,147,108 B2
(45) Date of Patent: Dec. 12, 2006

(54) METHOD AND APPARATUS FOR THE SEPARATION AND COLLECTION OF PARTICLES

(75) Inventor: Janice H. Nickel, Sunnyvale, CA (US)

(73) Assignee: Hewlett-Packard Development Company, LP., Houston, TX (US)

( * ) Notice: Subject to any disclaimer, the term of this patent is extended or adjusted under 35 U.S.C. 154(b) by 0 days.

(21) Appl. No.: 10/977,998

(22) Filed: Oct. 29, 2004

(65) Prior Publication Data

US 2006/0113219 A1 Jun. 1, 2006

(51) Int. Cl.
*B03C 1/23* (2006.01)

(52) U.S. Cl. ..... 209/227; 209/214; 209/225

(58) Field of Classification Search ..... 209/213–215, 209/223.1, 225, 227
See application file for complete search history.

(56) References Cited

U.S. PATENT DOCUMENTS 5,169,006 A * 12/1992 Stelzer ..... 209/223.1
5,536,475 A * 7/1996 Moubayed et al. ..... 422/101
5,628,407 A * 5/1997 Gilbert et al. ..... 209/214
5,655,665 A * 8/1997 Allen et al. ..... 209/223.1
5,834,121 A * 11/1998 Sucholeiki et al. ..... 428/407
6,117,398 A * 9/2000 Bienhaus et al. ..... 422/101
6,132,607 A * 10/2000 Chen et al. ..... 210/208
6,806,050 B1 * 10/2004 Zhou et al. ..... 435/6
6,858,439 B1 * 2/2005 Xu et al. ..... 436/518
2002/0166800 A1 * 11/2002 Prentiss et al. ..... 209/214

* cited by examiner

*Primary Examiner*—Joseph C. Rodriguez

(57) ABSTRACT

A separation operation for particles includes loading particles of various sizes and responsive to electromagnetic forces into a starting position upon a separation collection component, sending a first current through a first set of conductors in a first direction drawing a subset of larger particles toward a first adjacent position to the starting position and sending successively lower currents compared to the first current through a second set of conductors in the first direction drawing a subset of smaller particles toward a second adjacent position to the starting position. A collection operation includes sending a lower current through a first set of conductors near a subset of smaller particles that forces the smaller particles into a first particle collection point and sending a higher current through the second set of conductors to collect a subset of larger particles into a second particle collection point.

27 Claims, 6 Drawing Sheets

METHOD AND APPARATUS FOR THE SEPARATION AND COLLECTION OF PARTICLES

BACKGROUND

The present application is generally directed to separating particles used in scientific procedures. In the past, laboratories have used centrifuges to separate target materials based on mass and/or filtration systems to separate them based on size. While these separation methods worked well in some cases, they were not suitable for high throughput testing required in biotechnology and other fields as they were time consuming and complex in their implementation. A third approach to separation uses magnetic flux to separate these target materials by way of specially formulated magnetic particles.

Small particles having either magnetic or paramagnetic qualities are used by a growing number of laboratories to perform separation in experiments and procedures. Unlike the purely magnetic particles, the paramagnetic type particles are responsive to magnetic and electromagnetic fields yet tend not to retain magnetic qualities outside the presence of these fields. This allows particles to be manipulated by magnetic fields yet not suffer from packing and particle aggregation over time. For purposes of discussion, reference to particles includes those considered magnetic, paramagnetic as well as super-paramagnetic.

The particles are typically sphere-like in shape and due to the nanometer radii they possess are particularly useful in nanotechnology and biotechnology applications. While these sphere-like particles are the most prevalent, the shape and size of the particle may vary depending on the experiment being performed and the particles available or suitable for the experiment or procedure. Consequently, a wide range of particle sizes are being manufactured to accommodate the various types of experiments and procedures.

In one implementation, particles are functionalized through a coating of magnetite or other magnetically responsive material along with potentially one or more recognition molecules or substances to be used in a particular experiment. The core of these magnetically coated particles can be non-magnetic if desired. Alternatively, the functionalized particles can include a magnetic core while the coating is of a non-magnetic material such as gold (Au).

The recognition molecule on the particle reacts with and captures a target in a given sample. Magnets attract the particles along with the target in the given sample while the unbound non-reactive portion of the sample is washed away or collected for other subsequent procedures. For example, functionalized magnetic microspheres have been used in Polymerase Chain Reaction (PCR) related procedures to accurately manipulate small sample sizes and otherwise help reduce the time spent performing experimental and often complex procedures.

To maintain consistent and reliable results in the laboratory, it is important that the particles are extremely close in size. Manufacturers are therefore required to create particles that are close in size or fit within a small range or degree of tolerance. Unfortunately, obtaining particle uniformity during manufacture is very time consuming and greatly increases costs. As a second measure, manufacturers have attempted to separate the particles by size using filtration thus ensuring the particles are no larger than a predetermined upper threshold. Additional techniques met with limited success have employed kinetic-magnetic washing to further refine the particle size into more specific categories. Once again, this latter methodology is time consuming and difficult to produce consistent results.

Laboratories need particles that are extremely close in size yet cost-effective for use in large-scale ongoing and automated experiments. For example, even particles described as ranging several microns in size with a small percentage of variability may not be sufficient for certain laboratories to use if reliable experimental and procedural results are expected. As much as possible, these particles need to be identified by their size and not just a threshold size they are alleged not to exceed.

BRIEF DESCRIPTION OF THE DRAWINGS

The present invention is illustrated by way of example and not limitation in the figures of the accompanying drawings in which.

SUMMARY OF THE INVENTION

Figure 1:
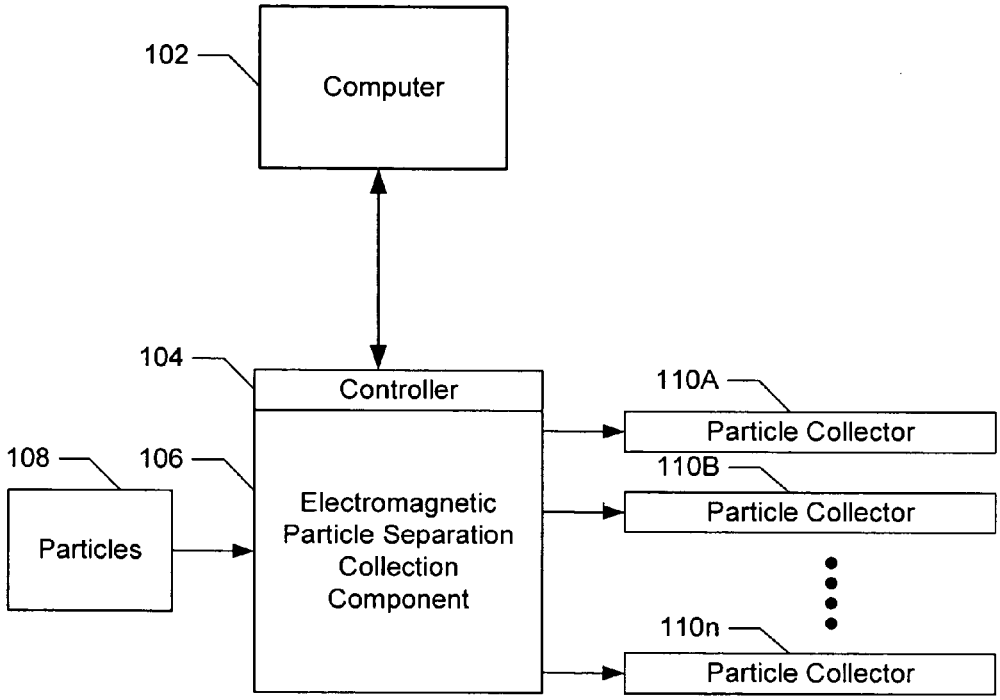
FIG. 1 is a schematic diagram showing a system for performing separation and collection in accordance with one implementation of the present invention.

One aspect of the present invention features a method of separating particles by size. The separation operation includes loading a set of particles of various sizes and responsive to electromagnetic forces into a starting position upon a separation collection component, wherein the separation collection component has a plurality of conductors each coupled to a current source, sending a first current through a first set of conductors in a first direction drawing a subset of larger particles from the set of particles toward a first adjacent position to the starting position on the separation collection component and sending one or more successively lower currents compared to the first current through a second set of conductors in the first direction drawing a subset of smaller particles from the set of particles toward a second adjacent position to the starting position on the separation collection component.

Another aspect of the present invention features a method of collecting particles by size. The collection operation includes sending a lower current through a first set of conductors associated with a separation collection component near a subset of smaller particles that forces the smaller particles into a first particle collection point, determining if a subset of larger particles near a second set of conductors on the separation collection component needs to be collected and sending a higher current through the second set of conductors associated with the separation collection component to collect the subset of larger particles into a second particle collection point in response to the determination.

The details of one or more embodiments of the invention are set forth in the accompanying drawings and the description below. Other features and advantages of the invention will become apparent from the description, the drawings, and the claims.

DETAILED DESCRIPTION

In one implementation, a grid of conductors arranged in rows and columns is used to separate particles into different sizes and then collect them in containers. Different amounts of current are run through the row and column conductors in the grid creating different strength electromagnetic fields. Each electromagnetic field tends to attract different size particles until all the particles have been separated. Another current applied to the rows and columns of the grid creates an electromagnetic force causing the particles to be collected in one or more particle collectors or containers.

Aspects of the present invention have one or more of the following advantages. Particles can be sorted more accurately by size rather than only a threshold level. The size of the particles is determined by the accuracy of the current source and the gradient of current applied to the conductors. Smaller particles can be separated from the larger particles by applying increasingly smaller amounts of current.

This separation method can be implemented with relatively low costs and with a high degree of repeatability. In one implementation, a grid used to separate the particles can be created using technology similar to that used in semiconductor fabrication. Each grid can be used to separate and collect a wide range of particle sizes. This allows the grid to be used by a different manufacturers and laboratories without significant modification or customization.

A computer system can be programmed to control the grid used for separating the particles. This increases the reproducibility of the separation operation and eliminates human error that might take place using other more mechanical or manual methods. Software can also be used to integrate the separation process into other automated experiments and procedures used in laboratories performing biotechnology and other types of research.

FIG. 1 is a schematic diagram showing a system for performing separation and collection in accordance with one implementation of the present invention. System 100 includes a computer 102, a controller 104, an electromagnetic particle separation collection component 106 or separation collection component 106, particles 108 and a set of particle collectors 110A, 110B, through 110*n* corresponding to each of the particle sizes being collected.

Computer 102 can be a general purpose personal computer (PC) or specialized hardware embedded with processors designed specifically to control separation collection component 106 and overall operation of system 100. Functionally, controller 104 exchanges control sequences and data between separation collection component 106 and computer 102 over any combination of one or more hardware, software, communication technologies and protocols including: FireWire, Universal Serial Bus, conventional serial or parallel communication, SCSI, HPIB (Hewlett-Packard Interface Bus)/GPIB (General Purpose Interface Bus)/IEEE-488, TCPIP, as well as other related, compatible or derivative technologies.

In addition, controller 104 provides one or more accurate current sources to drive the various conductors embedded in separation collection component 106. It is contemplated that each conductor can have a separate current source or alternatively share a current source through one or more switches or devices that allow the current source to be shared by one or more of the conductors. As will be described later herein, these current sources create electromagnetic fields of different strengths and orientations that enables accurate separation of particles 108 and their collection in a set of particle collectors 110*a*, 110*b*, through 110*n*. Alternatively, the accurate current sources described previously can be integrated into separation collection component 106 or provided through yet another component dedicated to providing highly accurate and variable current source. Yet another alternative implementation integrates controller 104, separation collection component 106 and one or more highly accurate current sources into a single integrated device.

Figure 2A:
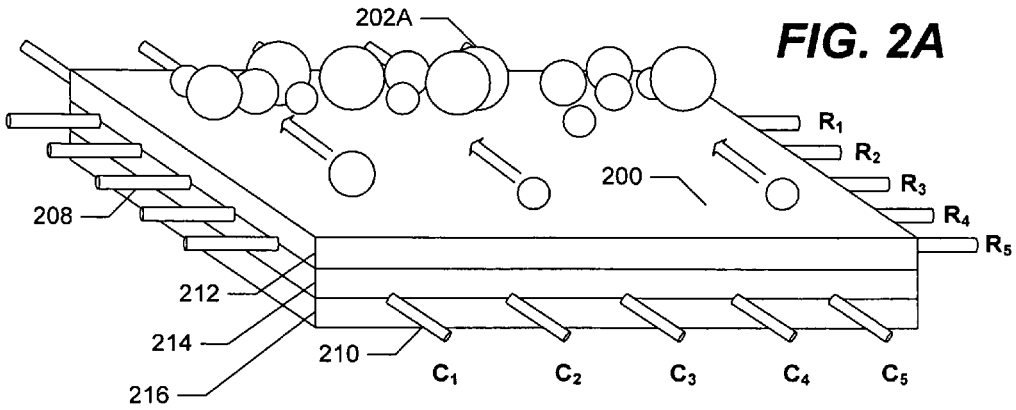
FIG. 2A is a schematic diagram of the initial positioning operation performed on particles placed on a separation collection component designed in accordance with one implementation of the present invention.

FIG. 2A is a schematic diagram of the initial separation operation performed on particles placed on a separation collection component designed in accordance with one implementation of the present invention. In the illustrated implementation, separation collection component 200 is a cross-point assembly or grid of row conductors 208 and column conductors 210 each positioned orthogonally to each other at substantially right angles. In one implementation the widths or spacing between row conductors 208 and column conductors 210 are identical and symmetric. Alternatively, row conductors 208 are separated by varying widths as are column conductors 210 and may be either symmetric or asymmetric around one or more different axis or angles depending on the application and need. Further, alternate implementation may also position the row conductors 208 relative to column conductors 210 at other than right angles to each other.

Figure 2B:
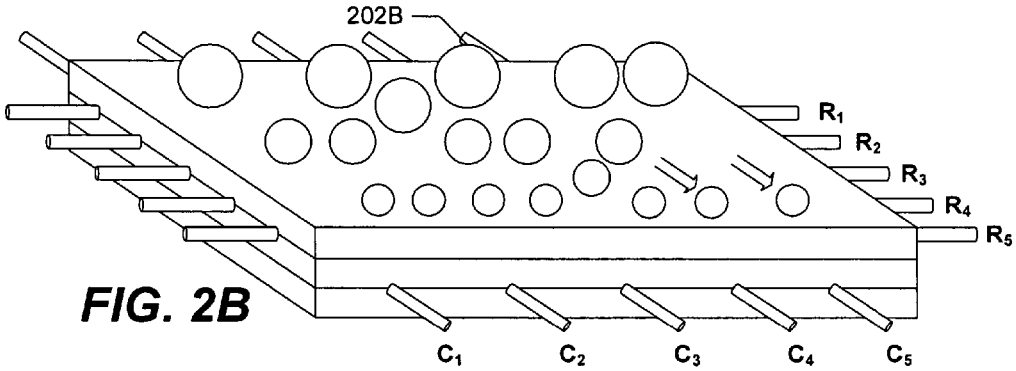
FIG. 2B is another schematic diagram illustrating the position of the particles after successively lower currents are applied through row conductors in accordance with one implementation of the present invention.
Figure 2C:
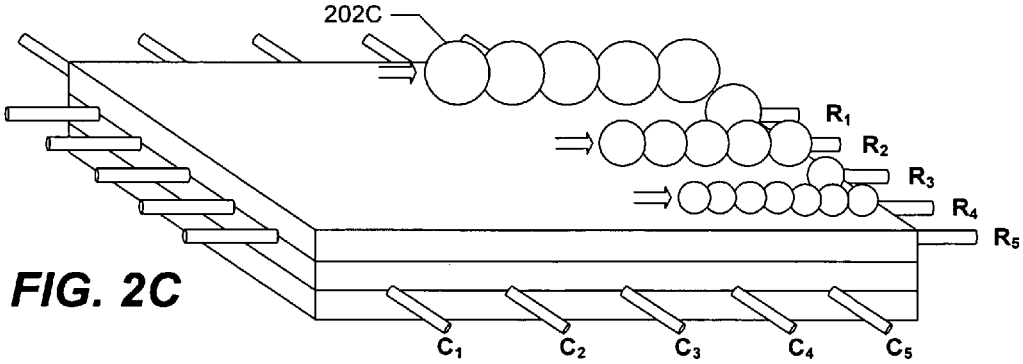
FIG. 2C is a schematic diagram of the collection operation performed on particles separated by a separation collection component designed in accordance with one implementation of the present invention.

As illustrated in this implementation, insulators 212 and 214 sandwich row conductors 208 and separate them from column conductors 210, which are sandwiched instead by insulators 214 and 216. Insulators 212, 214 and 216 can be manufactured from any number of non-conductive materials including Aluminum Oxide, Silicon Dioxide and Aluminum Nitride. Various semiconductor manufacturing processes can be used to assemble and create the insulators and cross-point assembly of conductors thus any dimensions depicted in FIGS. 2A, 2B and 2C are only demonstrative; actual dimensions will be determined by the design requirements and various manufacturing processes utilized. For example, it is desirable to make insulators 212, 214 and 216 thin so as to promote higher sensitivity and control over the particles during the separation and collection operations performed in accordance with implementations of the present invention.

In operation, a relatively high current is supplied in a first direction through a subset of row conductors 208 and column conductors 210 causing a correspondingly strong electromagnetic force to be applied to the particles in the direction of the arrows. In this example, the initial operation is designed to collect particles of all sizes into position 202A in the vicinity of row conductor $R_1$ as preparation for the subsequent steps used to separate the particles into smaller and smaller sizes. Alternatively, the particles can be collected in any arbitrary position on the grid by applying various combinations of current to a different set of row and column conductors. The strength of the electromagnetic force in this initial operation interacts with the magnetic, paramagnetic or superparamagnetic characteristics associated with the particles and overcomes any gravitational or other resistive forces until they are moved into the desired position 202A. It is important to select a sufficiently high current in this step as weaker electromagnetic forces generated through lower currents may not be sufficient to move all of the particles into position 202A.

In particular, FIG. 2B is another schematic diagram illustrating the position of the particles after successively lower currents are applied through another subset of row conductors 208 and column conductors 210 in accordance with one implementation of the present invention. This portion of the separation operation applies the successively lower currents in a substantially opposite direction (i.e., compared with the initial high current previously described) along the subset of row conductors 208 and column conductors 210 to create an opposing electromagnetic force that places the particles into position 202B. A first lower current monotonically lower than the higher current applied in reference to FIG. 2A is applied causing only the smaller of the particles to move slightly away from the vicinity of row conductor $R_1$ and towards row conductors $R_1$ through $R_5$. Once again, an alternate implementation could move the smaller particles to any arbitrary position on the grid by applying various combinations of current to a different set of row conductors 208 and column conductors 210. This leaves the largest of the particles in place as the resulting electromagnetic force associated with the first lower current is not sufficient to move the largest of the particles. By repeatedly applying successively lower currents along row conductors 208 and column conductors 210, the particles are separated into position 202B by size at or near the row conductors $R_2$ through $R_5$ as illustrated diagrammatically in FIG. 2B. Once again, this position of the particles is for illustration and the particles need not be aligned with any of row conductors 208 or column conductors 210 on the grid. It is contemplated that various implementations of the present invention can separate the particles into more homogenous groupings with smaller size differentials by increasing the number of row conductors 208 and column conductors 210 in addition to improving both the accuracy and control over the current source levels being applied.

Implementations of the present invention collect the particles once the separation operation has been completed. FIG. 2C is a schematic diagram of the collection operation performed on particles separated by a separation collection component designed in accordance with one implementation of the present invention. For example, the collection operation can be performed by applying various levels of current along the column conductors 210 in sequence. Starting with the smallest particles, an initial collection current applied along column conductors $C_1$ to $C_5$ creates an electromagnetic field that moves the particles in the direction of the arrow towards a particle collection point and into some type of collector. The initial collection current is small enough to move the smallest particles in the vicinity of row conductor $R_5$ but not move particles awaiting collection on any other portion of separation collection component 200. Monotonically larger currents are applied in succession causing correspondingly larger electromagnetic fields capable of moving the larger set of particles towards their respective collection points and collectors. Of course, if the particle collection point were not aligned along a row or column as illustrated in FIG. 2C then the currents would be applied along different combination of row and column conductors of the grid to move the particles toward the desired collection point.

Figure 3:
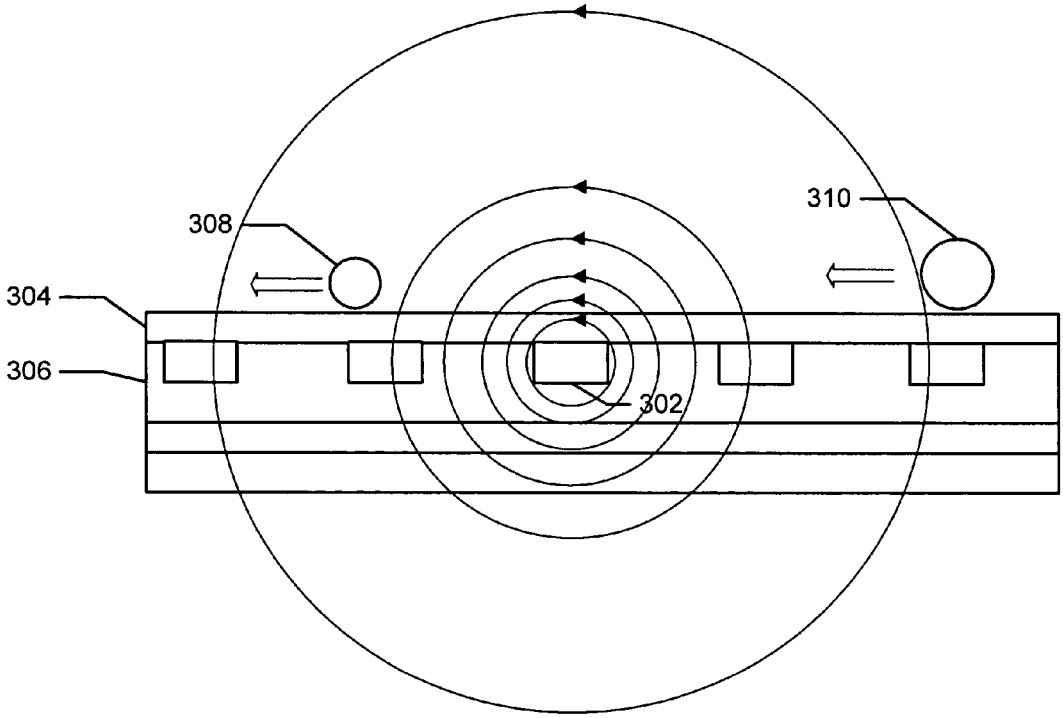
FIG. 3 is a cross-section schematic illustration of a separation collection component designed in accordance with one implementation of the present invention.

FIG. 3 is a cross-section schematic illustration of separation collection component designed in accordance with one implementation of the present invention. In this example, a current is being sent through a conductor 302 moving out of the plane of the image. Insulators 304 and 306 electrically isolate conductor 302 from other conductors yet are sufficiently thin to allow highly accurate control over the movement of particles 308 and 310. The effect of the magnetic field tends to move particle 308 more readily as it is smaller in size and mass in comparison to particle 310. These magnetic particles typically travel in the same direction as the magnetic field as illustrated.

Figure 4:
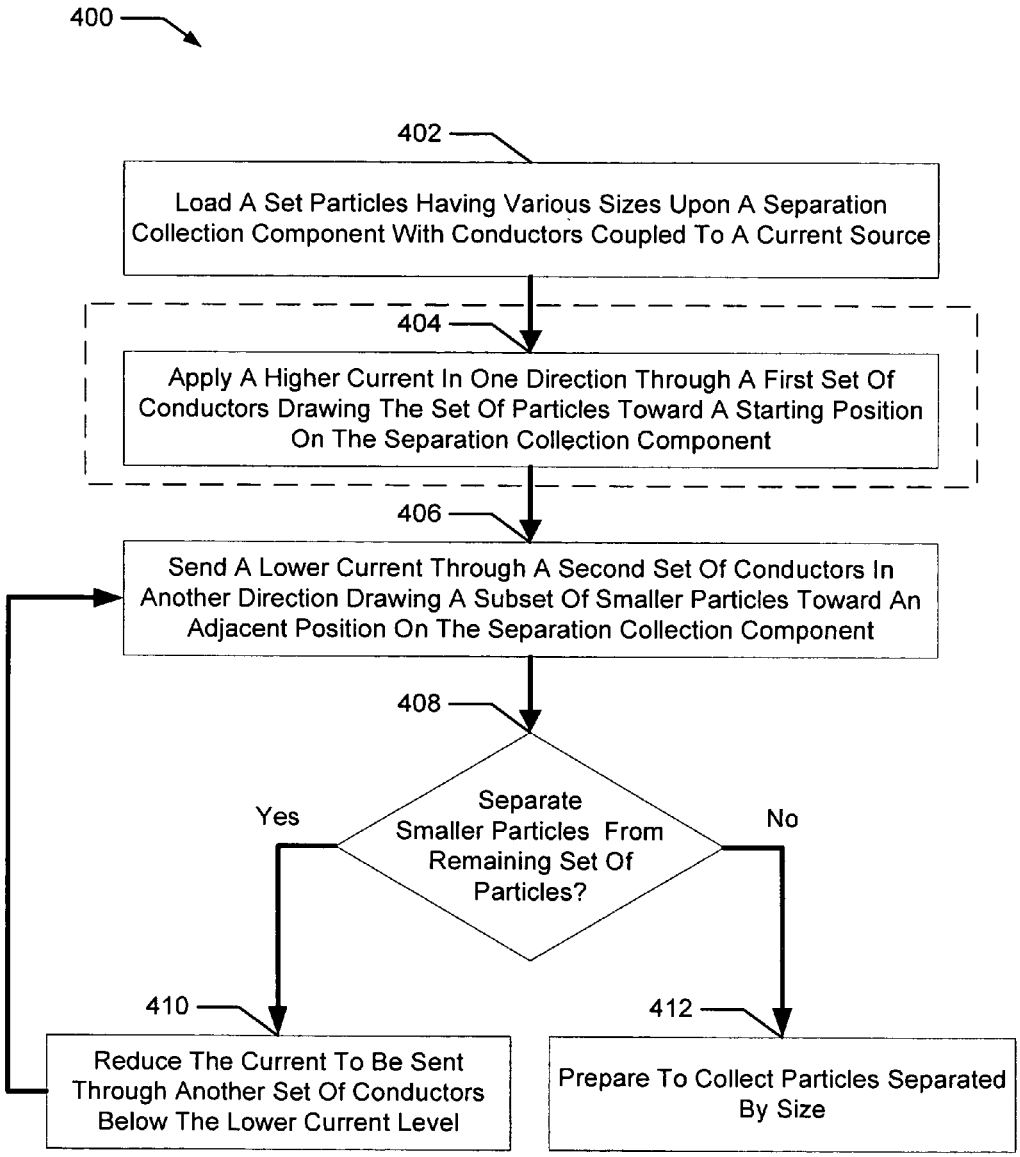
FIG. 4 is a flowchart of the operations for separating particles in accordance with one implementation of the present invention.

FIG. 4 is a flowchart of the operations for separating particles in accordance with one implementation of the present invention. To begin the separation operation, an operator or machine loads a set of particles having various sizes upon a separation collection component having one or more conductors each coupled to a current source (402). As previously described, the separation collection component in one implementation is arrangement of rows and columns of conductors in a grid. Each conductor can be connected to a separate current source or may share one or more current sources through a switching device, multiplexer or other similar device. The current sources can be either fixed at certain levels for each conductors or variable current sources that provide different current levels as needed by the different conductors.

Particles are generally already coated with magnetite or other magnetically responsive material. They also may have a magnetic core and a non-magnetic coating as previously described. Either arrangement gives the particles magnetic, paramagnetic or superparamagnetic qualities as needed and appropriate for the particular application. In one implementation, the particles can already be functionalized and therefore coated in advance with one or more recognition molecules designed to react with and capture a target from a given sample in an experiment or procedure. Alternatively, the particles can instead be functionalized later by coating the particles with recognition molecules subsequent to the separation and collection operations performed in accordance with implementations of the present invention.

As one option to starting the collection operation, one implementation of the present invention initially applies a higher current in a first direction through a first set conductors thus placing the particles into one area. This draws the set of particles towards the starting position on the separation collection component (404). The high current level creates a strong enough electromagnetic field to draw the largest particles to the starting position for the subsequent separation steps. The starting position can be an arbitrary position on the separation collection component or can intersect with one or more conductors aligned along a row, a column or a row and column of the separation collection component. Smaller particles are also drawn to the starting position as they are smaller in mass and have less gravitational and other forces to keep them in place. In this implementation, grouping particles of different sizes together is a precursor to the subsequent separation operations. However, an alternative implementation skips the above step by physically loading the particles as a group onto this starting area or working with particles already positioned otherwise in the desired area. For example, particles could be positioned in the desired starting area as a by-product of a preceding experiment, process or other event.

Next, implementations of the present invention send a lower current through a second set of conductors in a second direction. This draws a subset of smaller particles toward an adjacent position on the separation collection component (406). This adjacent position can be adjacent to the starting position or any arbitrary position on the separation collection component. By reversing or changing the direction of the current, the particles are now drawn away from the area in which they were initially grouped. Furthermore, the lower current creates a weaker electromagnetic field and only draws those particles smaller in size and mass rather than all the particles. Precise determination of the lower current can be done either experimentally or through various calculations based on the electrical and physical properties of the particles, the current source, the conductive materials used to create the separation collection component of the present invention and any other parts of the overall system. As previously described, the granularity and accuracy of the separation operation depends largely upon the number of conductors and the current differential applied between the conductors used by the separation collection component of the present invention. For example, smaller current gradients applied between a larger number of conductors leads to a finer separation of particle size.

Implementations of the present invention then determine if there are smaller particles to be extracted from the remaining set particles in the group (408). This generally depends on whether all the conductors have already been used to separate the particle sizes. If all the conductors have already been used, the separation process has been completed and implementations of the present invention instead prepare to collect the different particles separated by size along the collection points near the conductors (412).

If more conductors are available for particle separation, implementations of the present invention reduce the current to be sent through another set of conductors below the lower current level (410). Typically, the current level is reduced monotonically to a set of predetermined current levels to provide consistency in the separation operation. Successively reducing the current level again, leaves the larger particles in place and draws away only the smaller particles of a lesser mass. One or more of the above operations are repeated until the desired particle separation is achieved.

Figure 5:
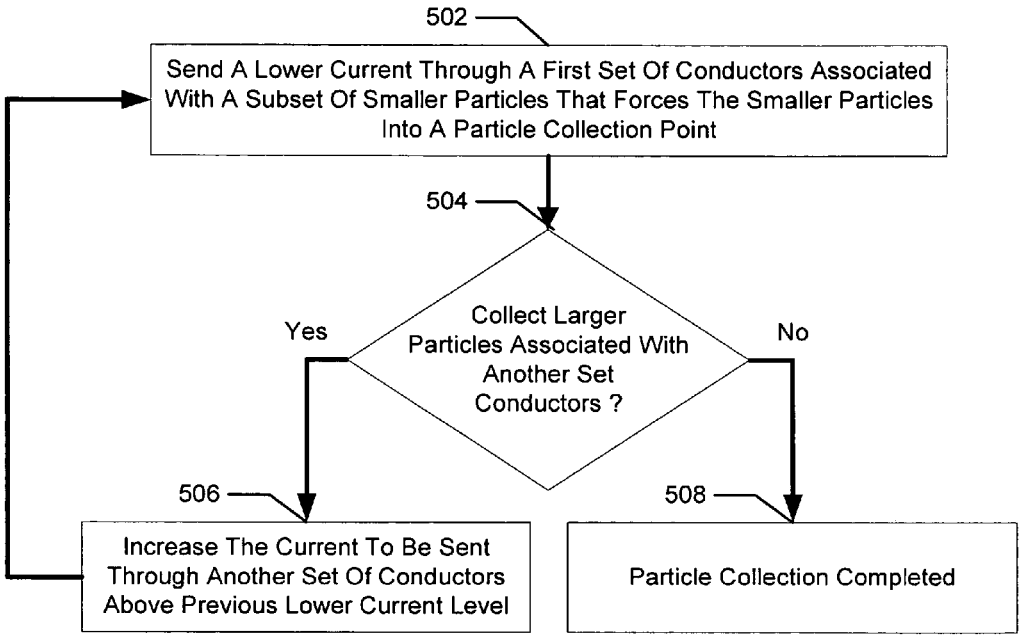
FIG. 5 is flowchart diagram of operations used in association with the collection of particles in accordance with one implementation of the present invention.

FIG. 5 is flowchart diagram of the operations used in association with the collection of particles in accordance with one implementation of the present invention. These steps are typically performed when the groups of particles on the separation collection component have already been separated by size. In one implementation, the collection operation begins by sending a lower current through a first set of conductors associated with a subset of smaller particles. The resulting electromagnetic field associated with the set of particles associated with the first set of conductors forces the smaller particles into a particle collection point (502). In one implementation, the collection operation starts with the smallest particles and therefore requires a smaller current level and electromagnetic field or force. The smaller current strong enough to collect the smallest particles yet not strong enough to disturb the adjacent or nearby larger particles also awaiting collection. Depending on the application, the particles can be collected in one of the many different types of microarrays or other vessels typically used in biotechnology, biology or other areas of nanotechnology. The particle collection operation is completed if there are no more particles to collect (508).

Figure 6:
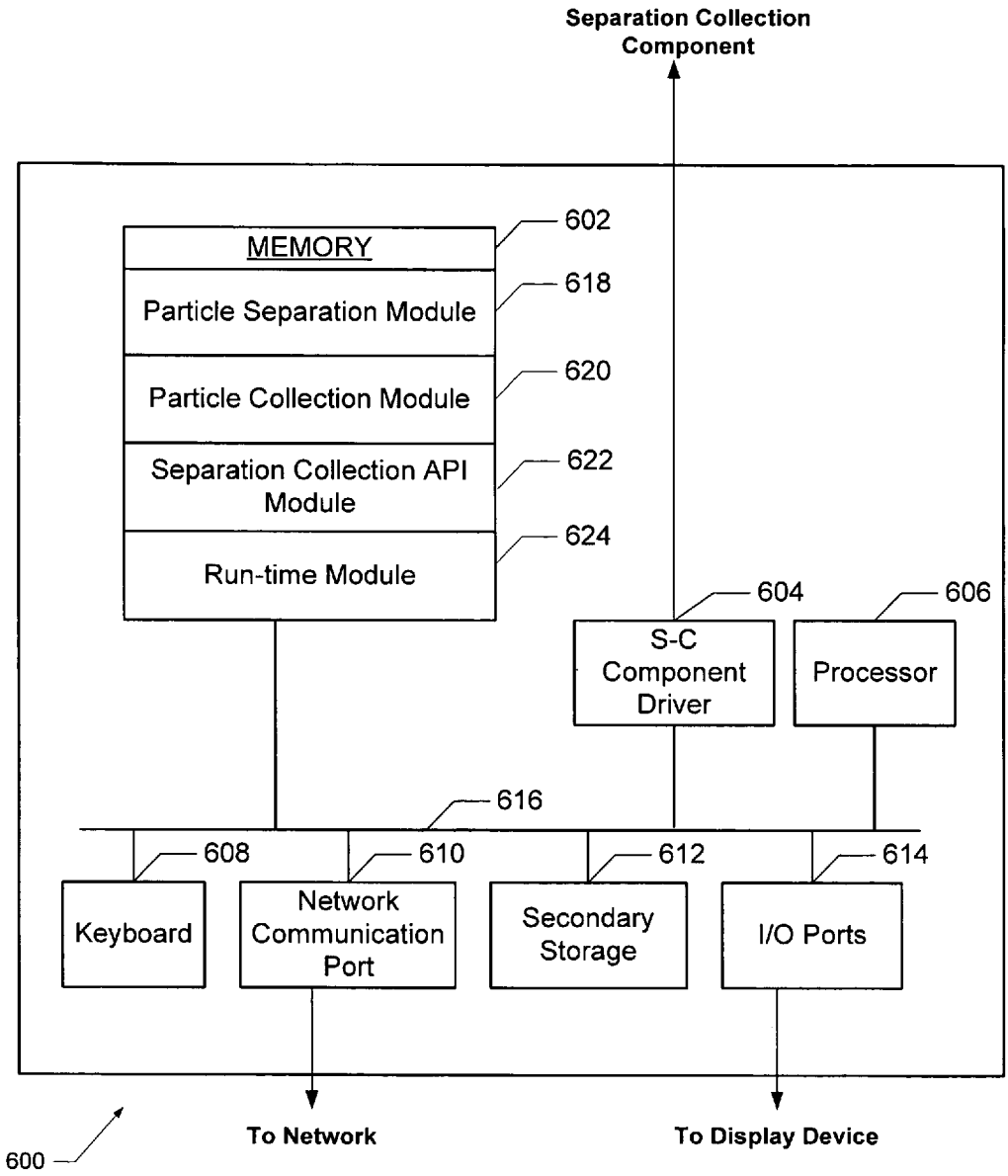
FIG. 6 is a diagram of a system used in one implementation of the present invention.

If there are larger particles remaining on the separation collection component, the collection operation continues using higher currents and electromagnetic forces. In particular, one implementation of the present invention increase the current to be sent through the set of conductors above the previous lower current level (506) and the collection operation repeats (502). As previously described, the current level selected creates a strong enough electromagnetic force to collect all of larger particles of one size and group but not large enough to disturb the other adjacent or nearby particles. Alternatively, if the physical separation between the particles is great enough then a larger current can be used to collect particles of different sizes as the distance between the particles would prevent mixing different sized particles. For example, this would enable the particles to be collected into their respective collectors in a parallel or in a simultaneous manner. Yet another implementation would involve physically sweeping or moving the particles into their respective collectors by way of a shunt or other appropriate type of device, FIG. 6 is a block diagram of a system 600 used in one implementation of the present invention. System 600 includes a memory 602 to hold executing programs (typically random access memory (RAM) or read-only memory (ROM) such as a flash ROM), an S-C (Separation-Collection) component driver 604 capable of interfacing with a separation collection component, a processor 606, a program memory 602 for holding drivers or other frequently used programs, a keyboard 608, a network communication port 610 for data communication, a secondary storage 612 with a secondary storage controller and input/output (I/O) ports and controller 614 operatively coupled together over an interconnect 616. System 600 can be preprogrammed, in ROM, for example, using field-programmable gate array (FPGA) technology or it can be programmed (and reprogrammed) by loading a program from another source (for example, from a floppy disk, a CD-ROM, or another computer). Also, system 600 can be implemented using customized application specific integrated circuits (ASICs).

In one implementation, memory 602 includes a particle separation module 618, a particle collection module 620, a separation collection application programming interface (API) module 622, and a run-time module 624 that manages system resources used when processing one or more of the above components on system 600. Particle separation module 618 provides routines, calculations and control sequences to S-C component driver 604 that separates particles in accordance with implementations of the present invention. For example, this includes determining the timing and current levels to apply to the various conductors of the separation collector component. Similarly, particle collection module 620 provides routines, calculations and control sequences to S-C component driver 604 but the information is used to instead collect the particles in accordance with implementations of the present invention. To facilitate integration into a larger test system, separation collection API module 622 provides system calls and libraries to interface with the underlying routines previously described. This is useful when integrating implementations of the present invention in automated systems that perform experiments and various procedures under the control of one or more systems and computers. Separation collection API module 622 is also useful for developing a customized interface tailored for use by trained technicians and/or users performing various experiments or procedures in a lab setting.

Embodiments of the invention can be implemented in digital electronic circuitry, or in computer hardware, firmware, software, or in combinations of them. Apparatus of the invention can be implemented in a computer program product tangibly embodied in a machine-readable storage device for execution by a programmable processor; and method steps of the invention can be performed by a programmable processor executing a program of instructions to perform functions of the invention by operating on input data and generating output. The invention can be implemented advantageously in one or more computer programs that are executable on a programmable system including at least one programmable processor coupled to receive data and instructions from, and to transmit data and instructions to, a data storage system, at least one input device, and at least one output device. Each computer program can be implemented in a high-level procedural or object-oriented programming language, or in assembly or machine language if desired; and in any case, the language can be a compiled or interpreted language. Suitable processors include, by way of example, both general and special purpose microprocessors. Generally, a processor will receive instructions and data from a read-only memory and/or a random access memory. Generally, a computer will include one or more mass storage devices for storing data files; such devices include magnetic disks, such as internal hard disks and removable disks; magneto-optical disks; and optical disks. Storage devices suitable for tangibly embodying computer program instructions and data include all forms of non-volatile memory, including by way of example semiconductor memory devices, such as EPROM, EEPROM, and flash memory devices; magnetic disks such as internal hard disks and removable disks; magneto-optical disks; and CD-ROM disks. Any of the foregoing can be supplemented by, or incorporated in, ASICs.

Thus, the invention is not limited to the specific embodiments described and illustrated above. For example, using a grid of conductors arranged in rows and columns is described however the grid could include only rows of conductors, only columns of conductors, an arbitrary arrangement of conductors or any other combination of conductors arranged in various configurations other than rows and/or columns. Accordingly, the invention is construed according to the claims that follow and the full-scope of their equivalents thereof.

What is claimed is:

1. A method of separating particles by size, comprising:

loading a set of particles of various sizes and responsive to electromagnetic forces into a starting position upon a separation collection component, wherein the separation collection component has a plurality of conductors each coupled to a current source;

sending a first current through a first set of conductors in a first direction drawing a subset of larger particles from the set of particles toward a first adjacent position to the starting position on the separation collection component;

sending one or more successively lower currents compared to the first current through a second set of conductors in the first direction drawing a subset of smaller particles from the set of particles toward a second adjacent position to the starting position on the separation collection component; and wherein loading the set of particles further comprises applying a higher current relative to the first current in a second direction through the first set of conductors drawing the set of particles towards the starting position on the separation collection component.

2. The method of claim 1 wherein loading the set of particles further comprises physically placing the set of particles upon the separation collection component.

3. The method of claim 1 wherein the separation collection component is a grid having rows and columns of conductors.

4. The method of claim 3 wherein the starting position, the first adjacent position and the second adjacent position are selected to intersect with a row conductor or a column conductor on the grid.

5. The method of claim 3 wherein the rows of conductors are separated from the columns of conductors by a non-conductive material.

6. The method of claim 5 wherein the non-conductive material is selected from a set of materials including: Aluminum Oxide, Silicon Dioxide, and Aluminum Nitride.

7. The method of claim 3 wherein the rows of conductors in the grid are positioned at right angles relative to the columns of conductors.

8. The method of claim 3 wherein the rows are separated by one or more widths and the columns are separated by one or more widths.

9. The method of claim 1 wherein each conductor from the plurality of conductors is each coupled to individual current sources.

10. The method of claim 1 wherein the plurality of conductors are coupled to one or more current sources through a switching device that shares the one or more current sources among the plurality of conductors.

11. The method of claim 1 wherein the starting position, the first adjacent position and the second adjacent position are arbitrary positions on the separation collection component.

12. The method of claim 1 wherein the set of particles are composed of paramagnetic materials.

13. The method of claim 1 wherein the set of particles are composed of magnetic materials.

14. The method of claim 13 wherein the magnetic materials include a magnetic coating around a non-magnetic core and non-magnetic coating around a magnetic core.

15. The method of claim 1 wherein the current source coupled to each conductor can be varied monotonically.

16. The method of claim 1 wherein the higher current in the second direction generates an electromagnetic force opposite in direction from the forces associated with the first current and the successively lower currents applied in the first direction.

17. The method of claim 1 wherein the higher current is greater in magnitude compared with the first current and successively lower currents.

18. The method of claim 1 wherein the subset of smaller particles include particles having a smaller radius than at least one particle in the set of particles.

19. The method of claim 1 wherein the subset of smaller particles includes particles having a smaller mass than at least one particle in the set of particles.

20. A computer program product for separating particles by size, comprising instructions operable to cause a programmable processor to:

load a set of particles of various sizes and responsive to electromagnetic forces into a starting position upon a separation collection component, wherein the separation collection component has a plurality of conductors each coupled to a current source;

send a first current through a first set of conductors in a first direction drawing a subset of larger particles from the set of particles toward a first adjacent position to the starting position on the separation collection component;

send one or more successively lower currents compared to the first current through a second set of conductors in the first direction drawing a subset of smaller particles from the set of particles toward a second adjacent position to the starting position on the separation collection component; and wherein the instructions that load the set of particles further comprises instructions that apply a higher current relative to the first current in a second direction through the first set of conductors drawing the set of particles towards the starting position on the separation collection component.

21. The computer program product of claim 20 wherein the separation collection component is a grid having rows and columns of conductors.

22. The computer program product of claim 21 wherein the rows of conductors are separated from the columns of conductors by a non-conductive material selected from a set of materials including: Aluminum Oxide, Silicon Dioxide, and Aluminum Nitride.

23. The computer program product of claim 20 wherein the separation collection component is an arbitrary arrangement of conductors.

24. The computer program product of claim 20 wherein the plurality of conductors are coupled to one or more current sources through a switching device that shares the one or more current sources among the plurality of conductors.

25. The computer program product of claim 20 wherein the starting position, the first adjacent position and the second adjacent position are arbitrary positions on the separation collection component.

26. The computer program product of claim 20 wherein the set of particles are composed of paramagnetic materials.

27. The computer program product of claim 20 wherein the set of particles are composed of magnetic materials.

* * * * *